United States Patent [19]

Larson et al.

[11] 4,296,989

[45] Oct. 27, 1981

[54] MULTI-CONDUCTOR FLAT CABLE CONNECTOR

[75] Inventors: Roderick W. Larson, Hudson, Wis.; Ralph D. Whaley, Roseville, Minn.

[73] Assignee: Minnesota Mining and Manufacturing Company, St. Paul, Minn.

[21] Appl. No.: 128,527

[22] Filed: Mar. 24, 1980

Related U.S. Application Data

[63] Continuation-in-part of Ser. No. 44,909, Jun. 4, 1979, abandoned.

[51] Int. Cl.[3] ..... H01R 11/20

[52] U.S. Cl. ..... 339/99 R

[58] Field of Search ..... 339/99 R, 97, 98

[56] References Cited

U.S. PATENT DOCUMENTS

| | | | |
|---|---|---|---|
| 3,611,264 | 10/1971 | Ellis | 339/99 R |
| 3,816,818 | 6/1974 | Meier | 339/99 R |
| 3,930,708 | 1/1976 | Wedekind | 339/99 R |
| 4,006,957 | 2/1977 | Narozny | 339/103 M |
| 4,026,625 | 5/1977 | Roiko | 339/99 R |
| 4,068,912 | 1/1978 | Hudson | 339/99 R |
| 4,101,189 | 7/1978 | Moser et al. | 339/99 R |
| 4,118,096 | 10/1978 | Takahashi | 339/99 R |
| 4,145,103 | 3/1979 | Knowles | 339/99 R |
| 4,160,573 | 7/1979 | Weisenburger | 339/99 R |
| 4,169,647 | 10/1979 | Knowles | 339/99 R |
| 4,188,083 | 2/1980 | Knowles | 339/99 R |

*Primary Examiner*—Joseph H. McGlynn
*Assistant Examiner*—John S. Brown
*Attorney, Agent, or Firm*—Cruzan Alexander; Donald M. Sell; Terryl K. Qualey

[57] ABSTRACT

A multi-conductor flat cable connector having a base carrying insulation stripping contact elements, a cover and a pair of metal latching legs retained on the cover. The base has cover guides at its ends which slidably mate with the ends of the cover and the latching legs latch the cover to the base in an open position to accept the flat cable and a closed position where conductors of the cable are connected by the contact elements. A pair of shearable latch stops, one at each end of the base, are contacted by portions of the latching legs when the connector is in an open position to hold the connector in the open position. The latch stops are sheared by the latching legs as the base and cover are forced together to connect a flat cable between them.

8 Claims, 9 Drawing Figures

MULTI-CONDUCTOR FLAT CABLE CONNECTOR

CROSS-REFERENCE TO RELATED APPLICATION

This application is a continuation-in-part of application Ser. No. 44,909 filed June 4, 1979 now abandoned.

FIELD OF THE INVENTION

The present invention relates to a multi-conductor flat cable connector having a preassembled base and cover.

BACKGROUND OF THE INVENTION

Multi-conductor flat cable connectors have generally included a base carrying insulation stripping contacts and a cover. The cover and base are shipped and stored unassembled and are assembled on a flat cable by the user. The user must thus handle two parts to apply the connector to the cable, which adds to assembly time, and one of the parts may be lost in shipment and storage.

More recently flat cable connectors have been made to be preassembled so that they are shipped and stored with the cover retained on the base. In the preassembled or open position the flat cable can be slid between the cover and the base and the cover and base are then forced together to force the cable into the contacts on the base. Such connectors are disclosed in U.S. Pat. Nos. 4,006,957 and 4,145,103. Plastic latches formed to hold the connector in the open position and the closed position, as disclosed in U.S. Pat. No. 4,006,957, have been subject to breakage. The metal latch clip of U.S. Pat. No. 4,145,103 is an improvement. However, when the connector of that patent is in the open position the cover and clip readily pivot on the base making it difficult to slide the cable between the cover and the base. Moreover, in the connectors of both patents the cover can be pushed into the base with only light pressure. Often, the cover is accidentally pushed onto the base before a cable is inserted between them requiring disassembly of the connector if it is to be used.

SUMMARY OF THE INVENTION

The multi-conductor flat cable connector of the present invention includes a base carrying a plurality of insulation stripping contact elements which extend from one surface of the base for making electrical connection to conductors of a flat cable. The base is formed centrally at each end with a generally rectangular cover guide extending perpendicularly from the one surface. A cover is positioned on the base and is formed at its ends to slidably mate with the cover guides on the base. A pair of metal latching legs extend one from each end of the cover. The latching legs latch the cover to the base in an open position permitting a flat cable to be inserted between the cover and the contact elements and upon movement of the cover to a latched closed position whereat conductors of the cable are connected by the contact elements. A pair of shearable latch stops, one at each end of the base, are positioned to be contacted by portions of the latching legs when the connector is in an open position and are shearable by the latching legs as the base and cover are forced together to move them to their closed position carrying the conductors of the cable into the contact elements.

THE DRAWING

Figure 2:
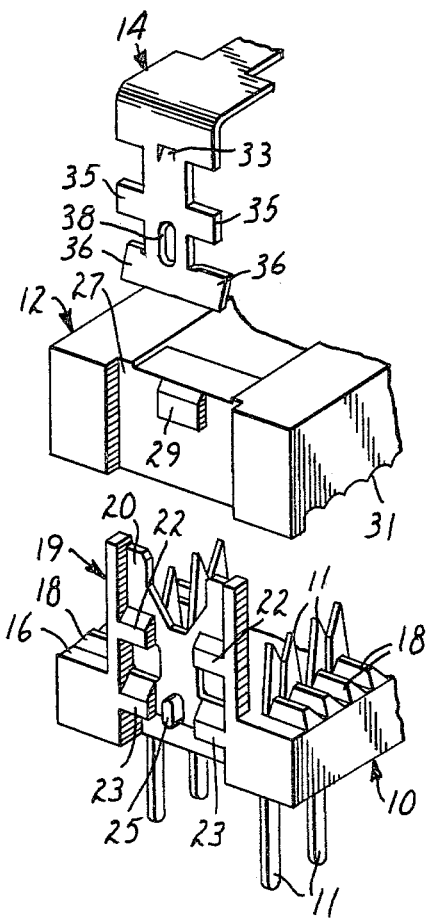
FIG. 2 is an exploded perspective view of the end of the connector of FIG. 1 to more clearly illustrate the separate parts.

The first embodiment of the connector of the present invention, illustrated in FIGS. 1 through 4, includes a base 10 carrying bifurcate insulation stripping contact elements 11, a cover 12 and a latching clip 14. In the preferred embodiment, the central portion of the connector omitted from FIGS. 1 and 4 repeats the structure illustrated adjacent the breaklines.

The contact elements 11 extend from the upper surface 16 of the base 10 in two parallel rows. Transverse lines across the base pass alternately through a contact in one row and then a contact in the other row to properly space the contacts 11 for making contact to each conductor of a flat cable 17. In the illustrated embodiment, the contact elements are formed with flat tails extending from the lower surface of the base in parallel rows with the tail of one contact element 11 in one row in line with the tail of a contact element in the opposite row to provide proper alignment with a dual inline integrated circuit package. In one preferred embodiment, fourteen contact elements 11 are provided, seven in each of the parallel rows.

Strain relief ribs 18 are formed on the upper surface 16 of the base 10 between the contact elements 11 and the adjacent edge of the base 10. One rib is formed on each side of the bifurcation in each contact element 11 to engage the insulation on a flat cable 17 between the conductors when the connector is closed.

The base is made of an insulating plastic material, such as glass reinforced polyester, and it is formed centrally at each end with a generally rectangular cover guide 19 extending perpendicularly from the upper surface 16 of the base. The exterior surface of each cover guide 19 is formed with a slot extending from top to bottom to define guides for the legs of the latching clip 14. Within the slot 20 each cover guide 19 is formed with two pairs of latching teeth 22 and 23, each pair of teeth 22 or 23 being laterally aligned at opposite edges of the slot 20 in the cover guide 19. A shearable latch stop post 25 is formed in the slot 20 between the lower pair of teeth 23 on each cover guide 19.

The cover 12 is formed of an insulating plastic material, such as glass reinforced polyester. It is recessed centrally at its ends at 27 to receive and slidably mate with the rectangular cover guides 19 extending from the base 10. Centrally at the top of each end recess 27 the cover is formed with a latching clip retainer projection 29. The lower surface of the cover 31 is scalloped across its width to provide a complementary guide surface to the usual scalloped pattern on one surface of the flat cable 17.

The latching clip 14 is generally U-shaped and it is made of metal, preferably stainless steel. The latching clip 14 is normally retained on the cover 12 by retention teeth 33 stamped into the metal of the clip at both ends of the clip to engage the latching clip retainer projections 29 on the cover. The main portion of each of the legs of the latching clip 14 is of a width to pass between the latching teeth 22 and 23 on the cover guide 19 and two pairs of edge tabs 35 and 36 extend from the main portion of each leg, each pair of tabs 35 or 36 being laterally aligned at opposite edges of the leg of the clip. The pairs of tabs 35 and 36 are spaced so that the upper edge tabs 35 engage the upper teeth 22 on the cover guide 19 when the lower edge tabs 36 engage the lower teeth 23 in the closed position of the connector.

Figure 1:
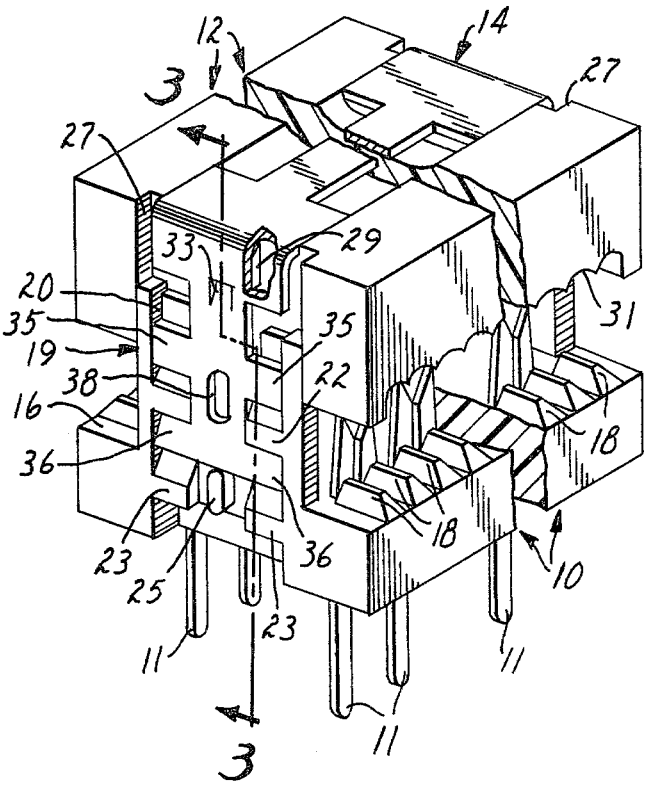
FIG. 1 is a perspective view of a first embodiment of a multi-conductor flat cable connector constructed in accordance with the present invention with the central portion of the connector broken away to shorten the length.
Figure 3:
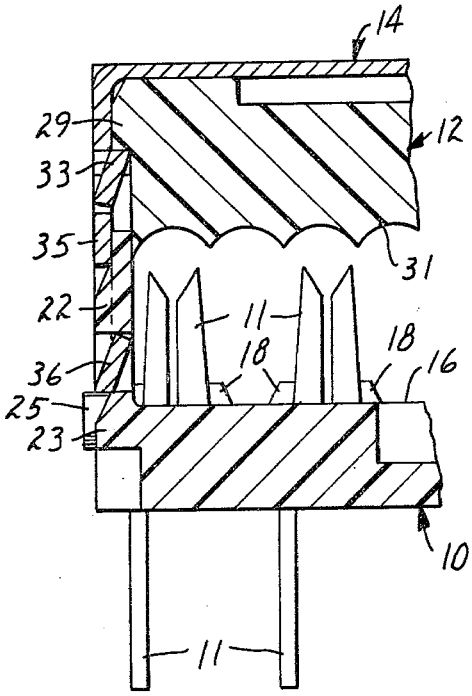
FIG. 3 is a cross sectional view taken along line 3—3 of FIG. 1.
Figure 4:
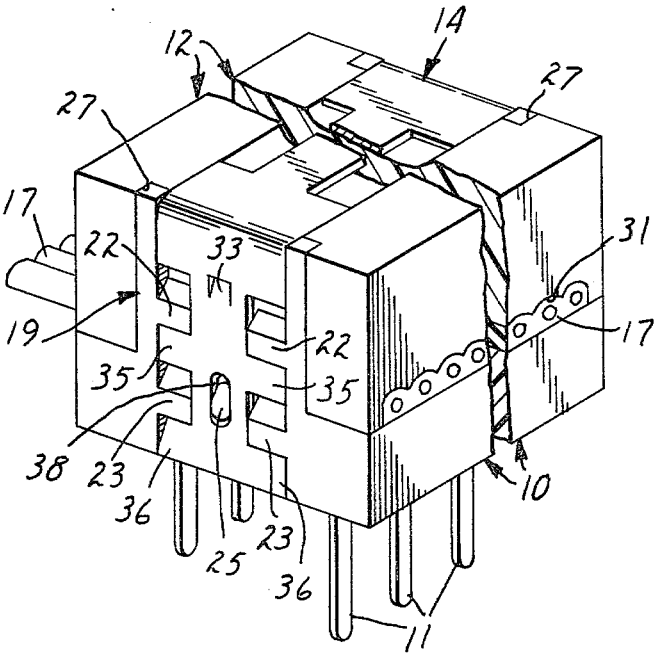
FIG. 4 is a view similar to that of FIG. 1 with a flat cable inserted into the connector and the connector moved to its closed position.
Figure 5:
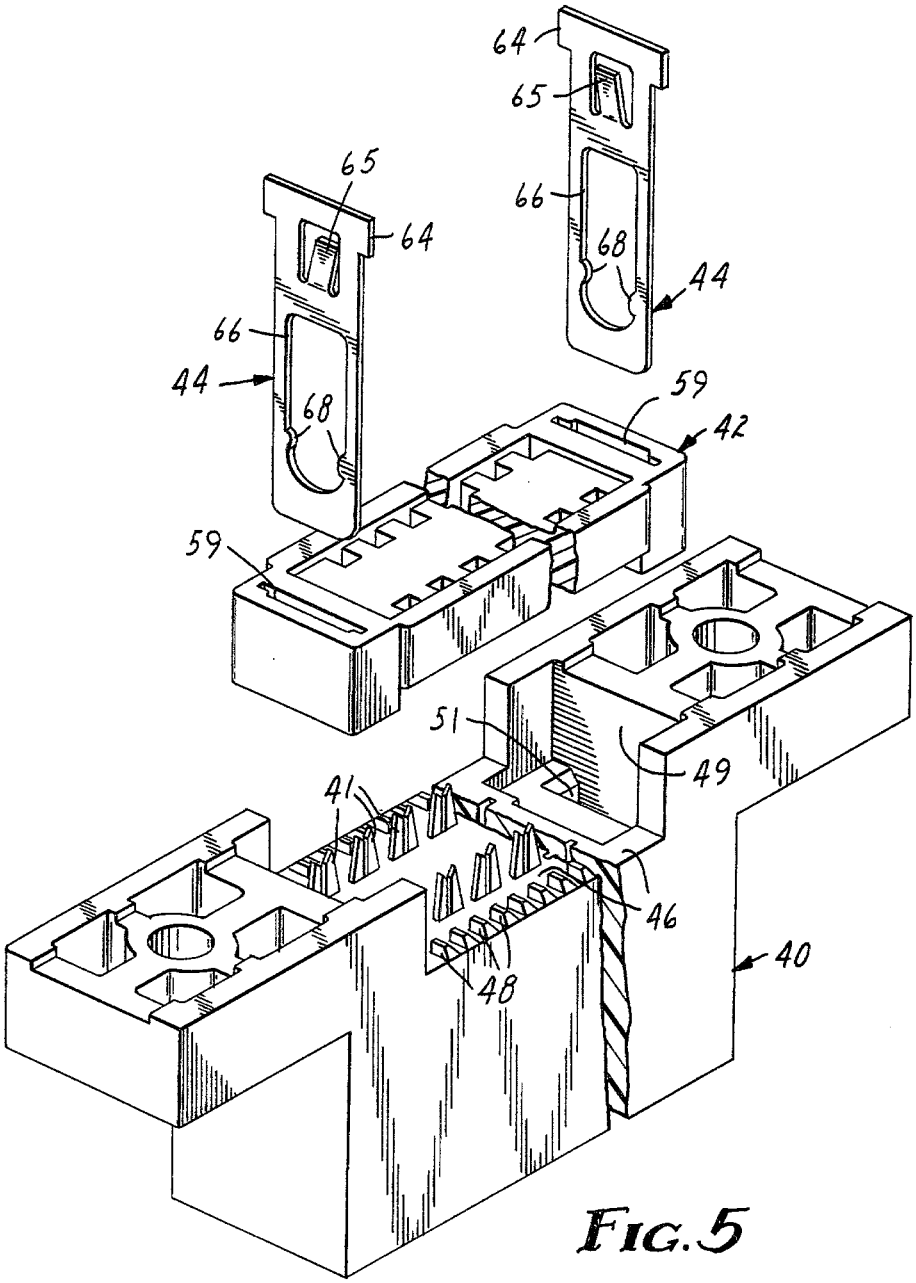
FIG. 5 is an exploded perspective view of a second embodiment of a multi-conductor flat cable connector constructed in accordance with the present invention with the central portion of the connector broken away.
Figure 6:
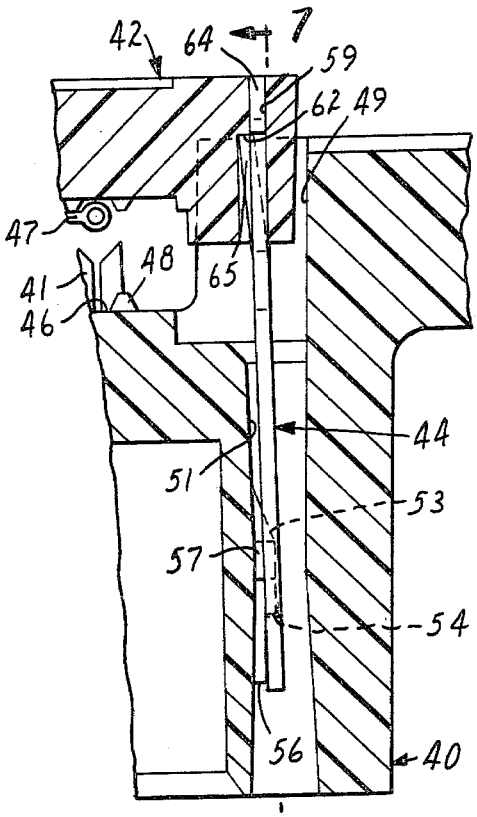
FIG. 6 is a longitudinal cross-sectional view of one end of the connector of FIG. 5 assembled and latched in an open position.
Figure 7:
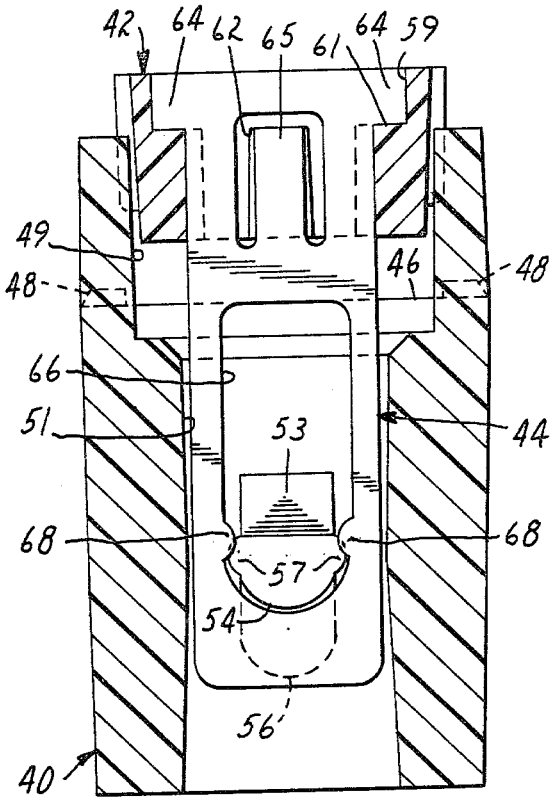
FIG. 7 is a cross-sectional view taken generally along line 7—7 of FIG. 6.
Figure 8:
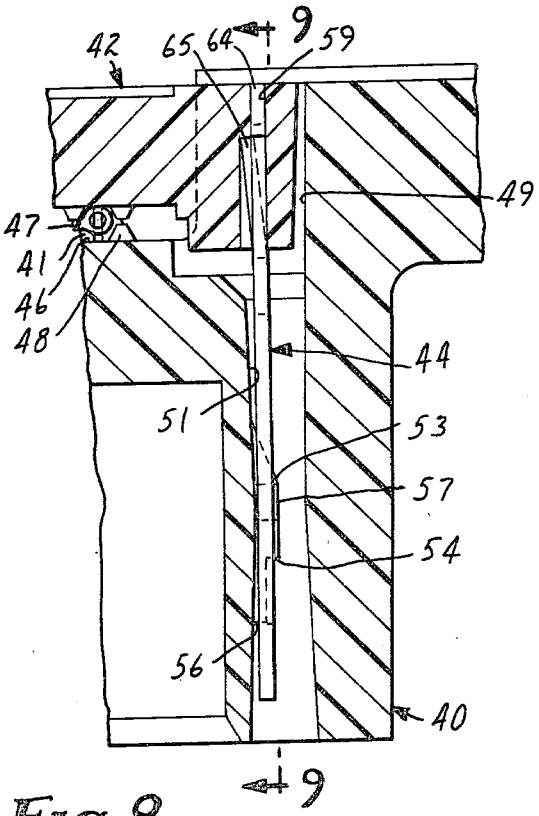
FIG. 8 is a view similar to that of FIG. 6 with the connector latched in a closed position.
Figure 9:
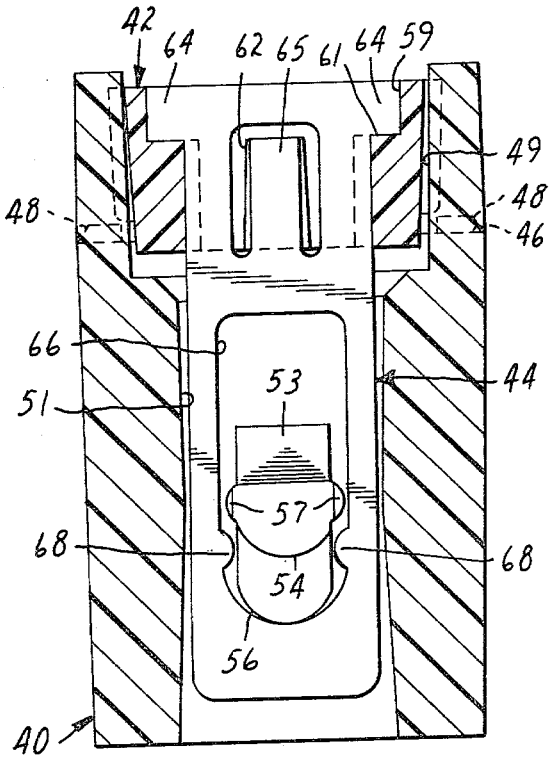
FIG. 9 is a cross-sectional view taken generally along line 9—9 of FIG. 8.

In manufacturing the connector, the base 10, the contact elements 11, the cover 12 and the latching clip 14 are separately formed. The contact elements 11 are inserted into the base 10 and the latching clip 14 is pressed onto the cover 12 to engage the metal retaining teeth 33 on the clip with the retainer projections 29 on the cover. The cover and clip are then placed over the base 10 and moved downward until the lower clip edge tabs 36 move over and engage the upper teeth 22 on the cover guide 19 as illustrated in FIG. 1. In this position the ends of the legs of the latching clip 14 abut the latch stops 25 and the cover guides 19 fit within the end recesses 27 in the cover. The connector is then ready for shipment and storage during which the engagement of the latching clip 14 with the latch stops 25 prevents inadvertent pressing of the cover from the open position to the closed position.

When it is desired to use the connector a flat cable 17 is inserted between the cover 12 and the contact elements 11, the scalloped lower surface 31 of the cover guiding the flat cable 17 into proper position with the conductors above the contact elements. Pressure is then applied to move the cover and base together to carry the conductors of the flat cable 17 into the contact elements 11. Upon application of sufficient pressure to make the connection, the ends of the latching clip 14 shear off the latch stops 25 and the lower latching clip edge tabs 36 move over the lower teeth 23 on the cover guide while the upper edge tabs 35 move over the upper teeth 22 to firmly latch the cover to the base. Apertures 38 in the legs of the latching clip 14 fit over the latch stops 25 to permit complete engagement of the edge tabs 35 and 36 with the teeth 22 and 23 even though the latch stops are not completely sheared off.

As the connector approaches its closed position, the strain relief ribs 18 on the upper surface of the base 10 engage the lower surface of the cable between the conductors to provide strain relief. A range of cable thicknesses may be used while still providing mechanical strain relief, the ribs 18 biting more deeply into the insulation of a thicker cable. The ribs must however be short in length, as illustrated, or the force necessary to move the connector to its closed position with a thick cable in place becomes prohibitably high.

The second embodiment of the connector of the present invention, illustrated in FIGS. 5 through 9, includes a base 40 carrying bifurcate insulation stripping contact elements 41, a cover 42 and a pair of identical latching legs 44. In the preferred embodiment, the central portion of the connector omitted from FIG. 5 repeats the structure illustrated to the left of the break lines.

The contact elements 41 extend from the upper surface 46 of the base 40 in two parallel rows. Transverse lines across the base pass alternately through a contact in one row and then a contact in the other row to properly space the contacts 41 for making contact to each conductor of a flat cable 47. The ends of the contact elements 41 not shown in the drawings are exposed in a rectangular opening extending from the bottom of the base 40 and they are formed to make electrical connection to leads on the opposite faces of printed circuit edge cards.

Strain relief ribs 48 are formed on the upper surface 46 of the base 40 between the contact elements 41 and the adjacent edge of the base. One rib 48 is formed on each side of the bifurcation on each contact element 41 to engage the insulation on a flat cable 47 between the conductors when the connector is closed. The base 40 is made of an insulating plastic material, such as glass reinforced polyester, and it is formed centrally at each end with a generally rectangular cover guide 49 extending perpendicularly from the upper surface 46 of the base. A latch opening 51 is formed at each end of the base 40, the end wall of the opening 51 being a continuation of the end wall of the corresponding cover guide 49. Within each latch opening 51 the base 40 is formed on the inner wall of the opening with an inclined surface 53 plateauing on a first latching lobe 54 followed by a step down to the face of a second latching lobe 56. The first latching lobe 54 extends from the surface of the second latching lobe 56 a distance generally equal to the thickness of the material of the latching legs 44 and the surface of the second latching lobe 56 extends a similar distance from the interior wall of the latch opening 51. At both edges of the first latching lobe 54 a shearable knob 57 is formed.

The cover 42 is formed of an insulating plastic material, such as glass reinforced polyester. It has rectangular ends to slidably mate with the rectangular cover guides 49 extending from the base 40. At each end the cover 42 is formed with a latching leg slot 59 therethrough. At the upper surface of the cover 42 and part way therethrough the slot 59 has a greater width than the major portion of the slot, providing stop shoulders 61 at the transition to the narrower width of the slot. Also, part way through the cover 42 the slot has an increased thickness defining a retention shoulder 62.

Each latching leg is formed from a strip of spring metal, such as stainless steel. It has a thickness generally equal to the narrower upper portion of a slot 59 through the cover 42. The major portion of a latching leg 44 has a width generally equal to that of the major portion of a slot 59 through the cover 42 and it is formed at one end with edge tabs 64 to engage the stop shoulders 61 in the cover 42. Centrally at the same end a retention tongue 65 is bent out of the major plane of the latching leg 44 to spring out and engage the retention shoulder 62 in the cover 42 when the edge tabs 64 contact the stop shoulders 61 to firmly retain the latching legs 44 on the cover 42. Centrally over a major portion of its length, each latching leg 44 is formed with a longitudinally extending aperture 66 into which a pair of opposed shearing ears 68 extend from the longitudinal edges thereof. The end of the aperture 66 spaced farthest from the cover 42 is arcuate to correspond to the arc of the first and second latching lobes 54 and 56 at each end of the base 40. The shearing ears 68 are spaced apart a distance less than the distance across the shearable knobs 57 and they are spaced from the arcuate end of the aperture 66 so that they contact the shearable knobs 57 as the arcuate end of the aperture 66 passes over the first latching lobe 54.

In use, the latching legs 44 are inserted one into each of the slots 59 in the cover 42 until the edge tabs 64 thereof engage the shoulders 61 in the cover and the retention tongue 65 thereof springs out of the remainder of the plane of the leg and engages the retention shoulder 62 in the cover to firmly retain the legs 44 on the cover. The cover is then placed over the base with the rectangular ends thereof aligned with the cover guides 49 of the base 40 and the latching legs 44 extending into the latch openings 51 at the ends of the base 40. The cover is moved downward into the base until the shearing ears 68 on each of the legs 44 contact shearable knobs 57 on the base 40 and the arcuate end of the aperture 66 in each leg engages a first latching lobe 54 on the base. The engagement of the shearing ears 68 with the shearable knobs 57 spaces the cover 42 above the base 40 a distance sufficient to permit a flat cable 47 to be inserted between the cover 42 and the contact elements 41 in the base 40. They resist finger pressure which might press the cover onto the base when not desired. The engagement of the arcuate end of the aperture 66 in each latching leg 44 with a first latching lobe 54 on the base prevents the cover from being removed from the base once assembled to the open position in which the cable can be inserted between the cover 42 and the contact elements 41. After a flat cable 47 has been inserted between the cover 42 and the contact elements 41 pressure is applied to force the base and cover together whereupon the shearing ears 68 on the latching legs 44 shear through the shearable knobs 57 on the base. As the cover and base are pressed together to their closed position in which the conductors of the flat cable 47 are forced into the contact elements 41, the arcuate end of each latching leg 44 moves over and engages a second latching lobe 56 on the base 40 to retain the cover on the base in the closed position.

We claim:

1. A multi-conductor flat cable connector comprising:

a base carrying a plurality of insulation stripping contact elements which extend from one surface of said base for making electrical connection to conductors of a said flat cable, said base being formed centrally at each end with a generally rectangular cover guide extending perpendicularly from said one surface, a cover on said base formed at its ends to slidably mate with said cover guides on said base, latching means on said cover including a pair of resilient metal latching legs, one extending from each end of said cover, means for latching said latching legs to said base in an open position permitting a said flat cable to be inserted between said cover and said contact elements and for latching said latching legs to said base in a closed position whereat conductors of a said cable are connected by said contact elements, and a pair of shearable latch stops, one at each end of said base, positioned to be contacted by portions of said latching legs when said connector is in an open position and shearable by said latching legs when said base and cover are forced together to move them to their closed position carrying the conductors of a said cable into said contact elements.

2. The connector of claim 1 wherein said latching legs are part of a generally U-shaped metal latching clip which extends over said cover from end to end.

3. The connector of claim 2 wherein said cover is recessed centrally at its ends to receive said rectangular cover guides of said base, said latching legs extend over the exterior of said cover guides and said latch stops are positioned one on the exterior of each said cover guide to be contacted by the ends of said latching legs when said connector is in an open position.

4. The connector of claim 3 wherein said cover guides are each externally formed with a slot extending from top to bottom to define guides for the legs of said latching clip.

5. The connector of claim 4 wherein said latching means comprises wedge shaped teeth on said cover guides within said slots at the lateral edges thereof and edge tabs on each leg of said latching clip mating with said teeth.

6. The connector of claim 5 wherein there are two pairs of said teeth on each of said cover guides, each pair of teeth being laterally aligned at opposite edges of a said slot in a said cover guide, and wherein there are two pairs of said edge tabs on each leg of said latching clip, each pair of tabs being laterally aligned at opposite edges of a leg of said clip.

7. The connector of claim 1 wherein each said latching leg is formed with a longitudinally extending aperture into which a pair of opposed shearing ears extend from the longitudinal edges thereof and wherein said latch stops each comprise a pair of knobs which said ears contact to hold said connector in an open position and through which said ears shear when said base and cover are forced together to move them to their closed position.

8. The connector of claim 7 wherein said means for latching said latching legs to said base comprises the end of the aperture in each said latching leg farthest from said cover engaging a first lobe on said base in said open position and a second lobe on said base in said closed position.

* * * * *